US006767886B2

(12) United States Patent
Fox et al.

(10) Patent No.: US 6,767,886 B2
(45) Date of Patent: Jul. 27, 2004

(54) SUBSTRATE TREATING COMPOSITIONS

(75) Inventors: Daniel Joseph Fox, Tenafly, NJ (US); David Van Blarcom, West Milford, NJ (US); Francoise Fredericks Meyer, Hackensack, NJ (US)

(73) Assignee: Unilever Home & Personal Care, USA division of Conopco, Inc., Greenwich, CT (US)

( * ) Notice: Subject to any disclaimer, the term of this patent is extended or adjusted under 35 U.S.C. 154(b) by 196 days.

(21) Appl. No.: 09/852,993

(22) Filed: May 10, 2001

(65) Prior Publication Data

US 2003/0017957 A1 Jan. 23, 2003

(51) Int. Cl.[7] ..... C11D 3/43

(52) U.S. Cl. ..... 510/513; 510/276; 510/287; 510/407; 510/292; 510/432

(58) Field of Search ..... 510/513, 276, 510/287, 407, 292, 432

(56) References Cited

U.S. PATENT DOCUMENTS

| | | | | | |
|---|---|---|---|---|---|
| 4,242,377 | A | * | 12/1980 | Roberts et al. | 427/242 |
| 4,526,781 | A | * | 7/1985 | Goldberg et al. | 424/70 |
| 5,534,165 | A | | 7/1996 | Pilosof et al. | |
| 5,663,134 | A | | 9/1997 | Trinh et al. | |
| 5,783,544 | A | | 7/1998 | Trinh et al. | |
| 5,968,404 | A | * | 10/1999 | Trinh et al. | 252/8.91 |
| 5,977,055 | A | * | 11/1999 | Trinh et al. | 510/515 |
| 6,001,343 | A | | 12/1999 | Trinh et al. | |
| 6,303,565 | B1 | * | 10/2001 | Clarke et al. | 510/527 |
| 6,495,058 | B1 | * | 12/2002 | Frankenbach et al. | 252/8.91 |

FOREIGN PATENT DOCUMENTS

| | | |
|---|---|---|
| WO | 98/56890 | 12/1998 |

* cited by examiner

*Primary Examiner*—Charles Boyer
(74) *Attorney, Agent, or Firm*—Alan A. Bornstein

(57) ABSTRACT

The present invention is directed to a composition for improving substrate characteristics. The composition has a substrate enhancing agent, like a monohydric alcohol, and the composition reduces wrinkles in substrates that have not been subjected to ironing.

7 Claims, 1 Drawing Sheet

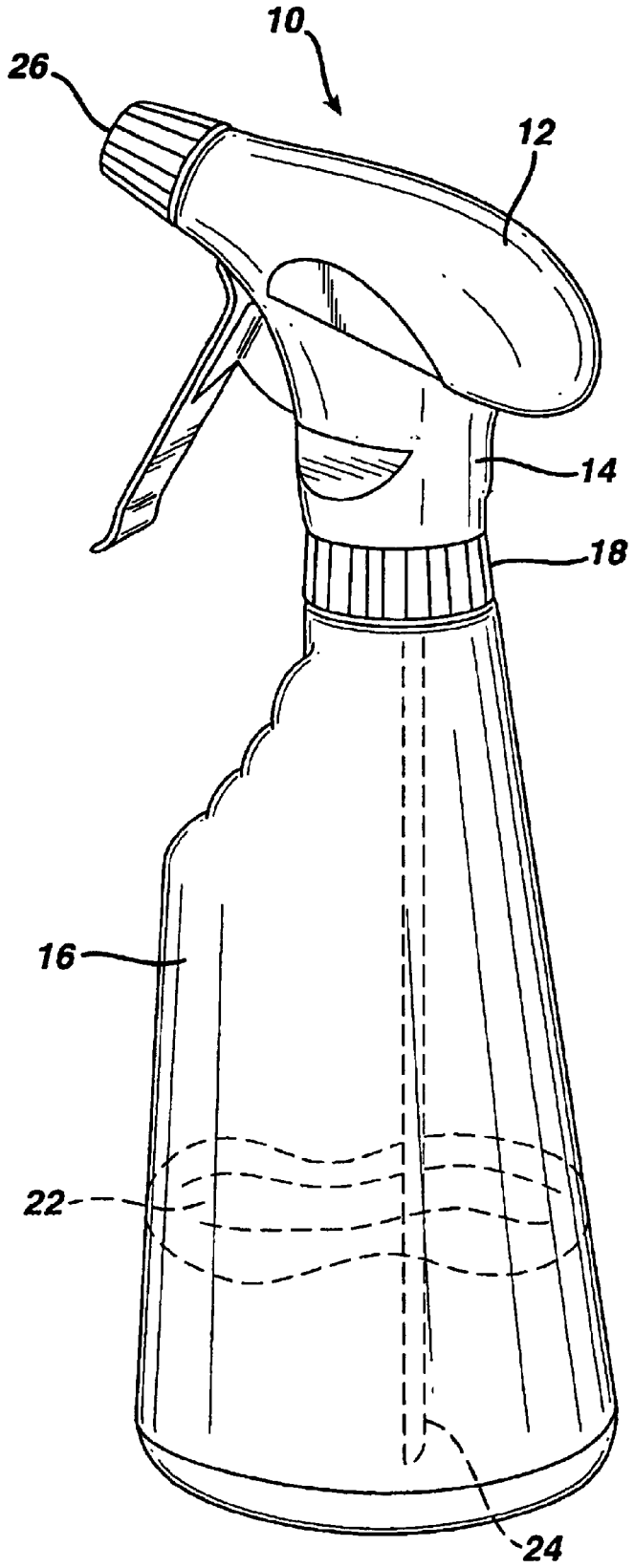
10
26
12
14
18
16
22
24

SUBSTRATE TREATING COMPOSITIONS

FIELD OF THE INVENTION

This invention is directed to a composition that may be used to treat a substrate. More particularly, the invention is directed to a composition that improves the characteristics of a substrate, like a fabric. The characteristics of the substrate are improved as a direct result of the composition and substrate coming into contact, and the improvements may be realized without the need to employ a mechanical washer, dryer, or ironing device.

BACKGROUND OF THE INVENTION

It is desirable in busy households to minimize the amount of work required to treat substrates. Particularly, it is very desirable to minimize the amount of work required to reduce or even eliminate, for example, wrinkles in substrates such as clothing. This is especially true when a consumer has worn clothing for a brief period of time and plans to wear the clothing a second time before having it, washed, dried and/or ironed.

Attempts to reduce wrinkles in clothing have been made, and especially with the introduction of durable permanent press treatments in the textile industry. Such treatments are known to employ polycarboxylic acids to strengthen the fibers of the textile, thereby rendering them less likely to wrinkle. Notwithstanding the above-described permanent press treatments, it is well settled that the effects of such treatments do not last long after the textiles (e.g., clothing) are subjected to a few washing cycles.

A need exists to reduce wrinkles in substrates, like clothing, that may not be subjected to washing, drying and/or ironing, even if the substrates have been subjected to permanent press treatments. This invention, therefore, is directed to a composition that improves the characteristics of a substrate as a direct result of the substrate coming into contact with the composition. The characteristics which are improved by the composition described in this invention include the reduction of substrate wrinkles and/or the reduction of substrate shape distortion.

Additional Information

Efforts have been disclosed for spraying surfaces. In U.S. Pat. No. 5,783,544, a spray composition for reducing malodor is described.

Still other efforts have been disclosed for spraying surfaces. In U.S. Pat. No. 5,663,134, a spray composition with less than 1.0% by weight of monohydric alcohol is described, and the composition is used to reduce malodor impressions on inanimate surfaces.

Even further, additional attempts have been made to spray surfaces. In U.S. Pat. No. 5,534,165, spray compositions with odor absorbing features are described.

None of the references above disclose a composition that may be sprayed on to a substrate in order to reduce wrinkle formation and/or shape distortion of the substrate. As used herein, substrate is defined to mean a textile having the capacity to wrinkle, including curtains, table cloths, upholstery, and especially, clothing. Substrate enhancing agent is defined to mean a compound (including oligomers and polymers) that results in a reduction in wrinkle formation and/or shape distortion of a substrate. Such a substrate enhancing agent is also meant to include a compound that enhances the wrinkle reducing properties of conventional wrinkle reducing additives.

SUMMARY OF THE INVENTION

In a first embodiment, this invention is directed to a composition for improving substrate characteristics, the composition comprising:

(i) from about 0.1 to about 20.0% by weight of a least one substrate enhancing agent selected from the group consisting of a polyhydric alcohol, a polyether, a monohydric alcohol and a mixture thereof; and (ii) greater than about 5.0% by weight water wherein the polyhydric alcohol is at least a $C_4$ polyhydric alcohol, the polyether comprises at least one alkylene chain of at least 4 carbons and the monohydric alcohol is at least a $C_5$ monohydric alcohol.

In a second embodiment, this invention is directed to a method for reducing wrinkles and/or shape distortion of a substrate by using the composition described in the first embodiment of this invention.

In a third embodiment, this invention is directed to an article of manufacture comprising the composition described in the first embodiment of this invention.

BRIEF DESCRIPTION OF THE DRAWINGS

The subject matter which is regarded as the invention is particularly pointed out and distinctly claimed in the concluding portion of the specification. The invention, however, may be best understood by reference to the following description taken in conjunction with the accompanying drawing figure in which:

The FIGURE illustrates a side view of a trigger sprayer which may be used to dispense the composition for improving substrate characteristics of this invention.

DETAILED DESCRIPTION OF THE PREFERRED EMBODIMENTS

There is no limitation with respect to the type of polyhydric alcohol used in this invention other than that the polyhydric alcohol has at least a $C_4$ carbon chain. Polyhydric alcohol, as used herein, is defined to mean a compound with more than one hydroxy group and no ether links within its backbone. An illustrative list of the polyhydric alcohols which may be used in this invention includes $C_4$ to $C_{18}$ alkane diols, like 1, 4-butane diol, 1, 5-pentane diol and 1, 10-decane diol. Others include $C_6$ to $C_{18}$ cycloalkane diols like 1, 4-cyclohexane diol.

The polyhydric alcohols which may be used in this invention can be prepared, for example, by base-or-acid-catalyzed cleavage reactions of epoxides, or by the oxidation of alkenes. Such polyhydric alcohols are also made commercially available by suppliers like Aldrich Chemical.

Regarding the polyethers which may be used in this invention, these compounds may be oligomers or polymers and have, in their respective backbones, at least one alkylene chain having at least 4 carbon atoms. An illustrative list of the polyethers (e.g., polyalkylene glycols) which may be used in this invention includes polybutylene glycol, polypentylene glycol, polyhexylene glycol, and any copolymers (including terpolymers) of the same.

The polyethers used in this invention are typically made by conventional techniques which include the polymerization of alkylene oxides via a mechanism initiated by anions. Such polyethers are also made commercially available by suppliers like Dow Chemical, and typically have a weight average molecular weight (mw) from about 500 to about 20,000; and preferably, from about 1000 to about 10,000, including all ranges subsumed therein.

The monohydric alcohols which may be used in this invention are limited only to the extent that they include alcohols having at least 5 carbon atoms in a linear chain. The preferred monohydric alcohols include those which have greater than about 7 carbon atoms. The most preferred monohydric alcohols include those which have greater than about 15 carbon atoms, like cetyl alcohol, octadecyl alcohol, and mixtures thereof (e.g., tallow alcohol).

The monohydric alcohols that may be used in the present invention may be prepared by any conventional technique, such as those which react acid chlorides with organometallic compounds. The monohydric alcohols which may be used in this invention may also be purchased from suppliers like Sigma.

There is no requirement for the substrate enhancing agent of this invention to be saturated, and therefore, such an agent may comprise sites of mono- or polyunsaturation. In an especially preferred embodiment, the substrate enhancing agent of this invention has a weight average molecular weight of greater than about 180 or a boiling point greater than about 216° C., or both.

There is no limitation with respect to how the composition of the present invention is made as long as the desired components are mixed to produce a composition that may be applied to a substrate. For example, the substrate enhancing agent may be added to a mixing vessel along with water. The amount of water in the composition that may be used to treat a substrate is greater than 5.0%, and typically, from about 70.0% to about 99.9% by weight of the total weight of the composition. Most preferably, however, water makes up from about 75.0% to about 97.0% by weight of total weight of the composition, including all ranges subsumed therein. The mixing of desired components may occur at conventional mixing rates. The temperature and pressure during mixing may vary, as long as the desired composition for improving substrate characteristics may be made. Typically, however, the composition of this invention may be made by mixing under conditions of moderate shear, with temperature being from about 25° C. to about 85° C. and pressure being atmospheric.

Optional additives which may be employed in the compositions of the present invention include low molecular weight alkanols (i.e., alcohols with a backbone of four (4) carbons or less). The low molecular weight alcohols which may be used in this invention may assist in improving the characteristics of the substrate being treated with the composition of this invention. Also, such low molecular weight alcohols can significantly decrease the drying time of the composition applied to the substrate, thereby enabling the consumer to, for example, use the substrate (e.g., clothing) shortly after being contacted with the composition. The amount of low molecular weight alcohols which may be used in this invention typically is from about 0.0% to about 10.0%, and preferably, from about 0.1 to about 9.0%, and most preferably from about 0.5% to about 5.0% by weight, based on total weight of the composition, including all ranges subsumed therein.

Other optional additives which may be used in conjunction with the substrate enhancing agents of the present composition include known lubricants like silicon comprising compounds, substituted vegetable oils, fatty acids or fatty acid esters and quaternary ammonium compounds and surfactants.

The silicon comprising compounds which may be used in this invention include those that may generally be classified as siloxanes, preferably those having a viscosity from about 10 to about one million centistokes at ambient temperature. The siloxanes which may be used in this invention include polydimethylsiloxane; ethoxylated organosilicones; polyalkyleneoxide modified polydimethylsiloxane; linear aminopolydimethylsiloxane polyalkyleneoxide copolymers; betaine siloxane copolymers; and alkylactam siloxane copolymers. Of the foregoing, the preferred siloxane is a linear aminopolydimethylsiloxane polyalkyleneoxide copolymer sold under the name Magnasoft SRS (available from Witco, Greenwich, Conn., USA). Silsoft A-843, another aminopolydimethylsiloxane polyalkyleneoxide copolymer available from Witco, is also a particularly preferred lubricant which may be used. The most preferred siloxane is, however, a polydimethylsiloxane sold under the name HV-600 by Dow Chemical.

Regarding the silicon comprising compounds, such compounds are preferably included in the compositions of the present invention in an amount from about 0.1 to about 10%, and preferably, from about 0.1% to about 5%, and most preferably, from about 0.3 to about 1.5% by weight silicon comprising compound (or mixtures of silicon comprising compounds), based on total weight of the composition for improving substrate characteristics, including all ranges subsumed therein.

The substituted vegetable oils which may be used in this invention include substituted canola, castor, palm, peanut and corn oil, including mixtures thereof. Regarding the substitution, any groups that increase the water solubility of the oil may be substituted thereon. Such groups include sulphate, sulphonate, phosphate and phosphonate groups as well as polyalkylene oxide groups like polyethylene oxide. As to the degree of substitution, the vegetable oil is substituted to the point where it is almost soluble in water, yet able to lubricate the fabrics it comes in contact with. Typically, from about 0.1 to about 15.0%, and preferably, from about 0.2 to about 10.0%, and most preferably, from about 0.3 to about 5.0% by weight substituted vegetable oil is used. Preferred substituted vegetable oils are sulfated caster oil such as SCO-50 and SCO-75, both made commercially-available by B.F. Goodrich.

The fatty acid or fatty acid ester which may be used in this invention includes fatty acids or there esters of stearic, oleic, palmitic, lauric, isostearic, myristic or behenic acids, as well as mixtures thereof. It is also understood that the fatty acid or esters thereof which may be used in this invention can comprise a mixture of compositions such as carnauba wax, candelilla wax, and natural or synthetic bees wax. The amount of fatty acid or esters thereof which may be used in the composition of this invention is typically from about 0.1 to about 10.0%, and preferably, from about 0.2 to about 5.0%, and most preferably, from about 0.3 to about 3.0% by weight fatty acid ester, based on total weight of the composition for improving substrate characteristics, including all ranges subsumed therein.

The quaternary ammonium compounds which may be used in this invention Include any of those typically found in fabric conditioning products. Such quaternary ammonium compounds include dialkyldimethylammonium chlorides and trialkylmethyl ammonium chlorides, wherein the alkyl groups have from about 12 to about 22 carbon atoms. Other quaternary ammonium compounds which may be used are, for example, ester containing quaternary ammonium compounds N,N-di(tallowyl-oxy-ethyl)-N,N-dimethyl ammonium chloride, N,N-di(tallowyl-oxy-ethyl)-N-methyl, N-(2-hydroxyethyl) ammonium chloride and mixtures thereof.

The amount of quaternary ammonium compound employed in the composition of this invention is typically from about 0.1 to about 5.0%, and preferably, from about 0.2 to about 4.0%, and most preferably, from about 0.3 to about 3.0% by weight quaternary ammonium compound, based on total weight of the composition for improving substrate characteristics, including all ranges subsumed therein.

The only limitation with respect to the surfactant which may be used in this invention is that the surfactant is compatible with the substrate enhancing agent used in the substrate treating compositions of this invention. The surfactants that may be used in this invention include commercially known nonionic, anionic, cationic, amphoteric and zwitterionic surfactants, including mixtures thereof. Such surfactants typically make up from about 0.5 to about 10 wt. % of the total weight of the substrate treating composition.

Nonionic surfactants are the preferred surfactants and they are defined to include those surfactants generally classified as fatty acid or alcohol condensates. Such surfactants are typically sold under the names Neodol, Plurafac, Dehypon and Synperonic and made commercially available from suppliers like Shell Chemical Company, Union Carbide, Condea, Stepan and BASF. The preferred nonionic surfactant used in this invention is an ethoxylated nonionic sold under the name Neodol 25-9 and made available by Shell Chemical Company.

It is also noted herein that odor reducing additives, like cyclodextrin, may be used in the composition of this invention. Cyclodextrin, as used herein is meant to include cyclodextrins containing from 6 to 12 glucose units; especially, alpha-cyclodextrin, beta-cyclodextrin, gamma-cycodextrin, derivatives thereof or mixtures thereof. The amount of cyclodextrin which may be used is typically from about 0.1 to about 7.0% by weight cyclodextrin, based on total weight of the composition for improving substrate characteristics, including all ranges subsumed therein. A more detailed description of such odor reducing additives may be found in International Application No. WO 98/56890.

Still other optional additives which may be used in this invention include well known and commercially available colorants, fragrances such as Koala Kool MOD-C made available by Takasago, preservatives, pH control agents, viscosity adjusting agents such as inorganic salts, hydrotropes such as sodium xylene sulfonate, anti-oxidants such as butylated hydroxy toluene, foam control agents, chelants, enzymes (e.g., lipases, amylases, proteases), dye transfer inhibitors and anti-clogging agents. When used, these optional additives, collectively, make up less than about 10.0% by weight of the total weight of the composition for treating a substrate.

The composition for treating a substrate of this invention may be applied to the substrate with, for example, a dispenser like roller, aerosol dispenser, pump sprayer or trigger sprayer. The figure depicts a trigger sprayer 10 having a head 12, a neck 14 and a bottle 16. The bottle 16 is connected to the neck 14 via twist connector 18. Trigger 20, when engaged, causes the composition for improving substrate characteristics 22 to be drawn through the delivery tube 24 and the exit nozzle 26 in order to deliver the composition for improving substrate characteristics 22 on to a substrate (not shown).

The composition for improving substrate characteristics of this invention is preferably applied on to a substrate at portions of the substrate that are most likely to wrinkle. If desired, however, the entire substrate may be subjected to the composition. When applying the composition for improving substrate characteristics, the amount of composition applied is enough to improve the characteristics of the substrate and just enough to allow the substrate to dry (at ambient temperature) in under about three (3) hours, and preferably, in under about one (1) hour, and most preferably, in under about one-half (½) hour. Also, it is noted that after applying the composition of the present invention to the substrate, little or no discernible markings (e.g., stains, water marks or rings) may be found on the substrate when the composition is completely dry.

Instructions may be provided with the composition for improving substrate characteristics of this invention. Such instructions, where applicable, educate an end user to apply the composition of this invention to a substrate and then to immediately (e.g., within about five (5) minutes) hang the substrate up or place the substrate on a flat surface. The instructions may also suggest to the end user to apply the composition of this invention to a substrate and then to either tension and smooth the garment or to iron the substrate before or after (preferably after) the composition for improving substrate characteristics dries.

The examples are provided to further illustrate and facilitate a better understanding of the compositions for improving substrate characteristics of this invention. The examples are not meant to limit the accompanying claims.

Example 1–6[A]

| Component | 1 | 2 | 3 | 4 | 5 | 6 |
|---|---|---|---|---|---|---|
| Ethanol | 5.0 | 5.0 | 2.0 | — | 4.0 | 3.0 |
| Sulfated castor oil | 0.5 | 2.0 | — | — | — | — |
| Silicone[B] | — | — | .5 | 1.0 | — | 2.0 |
| Ethoxylated nonionic[C] | 1.0 | 2.0 | 1.0 | — | 2.0 | 1.0 |
| Tallow alcohol | 3.0 | 1.5 | — | — | 5.0 | 4.0 |
| Methyl methoxy butanol | — | 2.0 | 5.0 | 4.0 | 4.0 | 3.0 |
| Ditallow, dimethyl ammonium chloride | — | — | — | — | 2.0 | — |
| Octadecyl alcohol | — | — | 2.0 | 4.0 | — | — |
| Fragrance[D] | 0.5 | 0.5 | — | 0.5 | 02 | 0.5 |
| Water | To 100% | To 100% | To 100% | To 100% | To 100% | To 100% |

[A]Examples 1–6 may be made by mixing the components, in no particular order, under conditions of moderate sheer at temperatures from about 25° C. to about 85° C.
[B]MagnaSoft SRS (Witco) (Examples 1–5); HV-600 PDMS (Example 6).
[C]Neodol 25-9 (Shell Chemical).
[D]Koala Kool MOD-C (Takasago).

What is claimed is:

1. A method for reducing wrinkles, shape distortion or both from a substrate comprising the steps of:

(a) contacting the substrate with a sprayable composition comprising:

(i) greater than 3.0% by weight of a least one substrate enhancing agent selected a $C_7$ or higher monohydric alcohol; and (ii) greater than 5.0% by weight water; and (b) allowing the substrate to dry.

2. The method according to claim 1, wherein the monohydric alcohol is tallow alcohol.

3. The method according to claim 1, wherein the composition further comprises a surfactant.

4. The method according to claim 3, wherein the composition further comprises a silicon comprising compound, a substituted vegetable oil, a fatty acid ester, a quaternary ammonium compound or mixtures thereof.

5. The method according to claim 1 wherein the substrate enhancing agent is a monounsaturated or polyunsaturated $C_7$ or higher monohydric alcohol.

6. The method according to claim 1 further comprising the step of hanging the substrate up or placing the substrate on a flat surface after contacting the substrate with the composition.

7. The method according to claim 1 further comprising the step of ironing the substrate.

* * * * *